US010400766B2

(12) United States Patent
Murata

(10) Patent No.: US 10,400,766 B2
(45) Date of Patent: Sep. 3, 2019

(54) GEAR PUMP OR MOTOR

(71) Applicant: SHIMADZU CORPORATION, Kyoto (JP)

(72) Inventor: Kazuma Murata, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 15/086,063

(22) Filed: Mar. 31, 2016

(65) Prior Publication Data

US 2016/0290336 A1 Oct. 6, 2016

(30) Foreign Application Priority Data

Apr. 3, 2015 (JP) ..... 2015-076479

(51) Int. Cl.
*F04C 15/00* (2006.01)
*F04C 2/14* (2006.01)
*F03C 2/08* (2006.01)

(52) U.S. Cl.
CPC ..... *F04C 15/0034* (2013.01); *F03C 2/08* (2013.01); *F04C 2/14* (2013.01); *F04C 2230/60* (2013.01); *F04C 2240/56* (2013.01)

(58) Field of Classification Search
CPC ..... F03C 2/08; F04C 4/18; F04C 15/0034; F04C 2/14; F04C 2230/60; F04C 2240/56
USPC ..... 418/102, 132, 205, 204
See application file for complete search history.

(56) References Cited

U.S. PATENT DOCUMENTS 3,895,890 A * 7/1975 Laumont ..... F04C 15/0026 418/132
5,738,500 A * 4/1998 Sundberg ..... F01C 21/106 417/204
6,264,447 B1 * 7/2001 Woodcock ..... F04C 15/0038 184/61
6,808,374 B2 * 10/2004 Phallen ..... F04C 2/086 418/132

FOREIGN PATENT DOCUMENTS

JP 2002-257054 9/2002

OTHER PUBLICATIONS

Machine Translation JO 2002-257054 done Aug. 20, 2017.*
(Continued)

*Primary Examiner* — Mary Davis
*Assistant Examiner* — Dapinder Singh
(74) *Attorney, Agent, or Firm* — JCIPRNET

(57) ABSTRACT

The disclosure allows a gasket to be securely attached to a gasket groove, reduces a time for an operation of attaching the gasket to the gasket groove, and allows differentiation between gaskets of different materials. A gear pump or a motor, including gears which mesh together and form a pair, axes for pivotally supporting the gears, a body having a gear storing chamber internally for placing the gears, a cover for covering the gear storing chamber of the body, is characterized in that a gasket is disposed between the body and the cover, wherein the gasket is insertable to a gasket groove disposed on at least one of the body and the cover, the gasket groove having a shape surrounding the gear storing chamber, and the gasket sticks closely to the gasket groove due to an elastic restoring force when inserted to the gasket groove.

11 Claims, 3 Drawing Sheets

(56) References Cited

OTHER PUBLICATIONS

Zhang Fenghhan et al., "Kato Truck Crane Structure and Service Manual", Machine Industry Publisher, Nov. 2011, with partial English translation, pp. 1-10.
Mr. Hair, "Hydraulic and barometric driving", Beijine Institute of Technology Press, Jul. 2014, with partial English translation, pp. 1-4.
Raikennen, "Hydraulic pressure process manual", Machine Industry Publisher, Apr. 1990, with partial English translation, pp. 1-4.
"Office Action of China Counterpart Application," dated Jul. 12, 2018, with English translation thereof, p. 1-p. 16.
"Office Action of Japan Counterpart Application," dated Jan. 4, 2019, with English translation thereof, p. 1-p. 4.

* cited by examiner

GEAR PUMP OR MOTOR

CROSS-REFERENCE TO RELATED APPLICATION

This application claims the priority benefits of Japanese patent application no. 2015-076479, filed on Apr. 3, 2015. The entirety of the above-mentioned patent application is hereby incorporated by reference herein and made a part of this specification.

BACKGROUND OF THE INVENTION

Field of the Invention

The invention relates to drive gears which mesh together to form a gear pair and relates particularly to a gear pump or a motor which outputs an operating liquid using tooth grooves.

Description of Related Art

Conventionally, in a structure of a gear pump or a motor where gears which mesh together to form a pair are placed in a gear storing chamber, a gasket for preventing operating liquid from leaking to the outside is disposed between a body having the aforementioned gear storing chamber internally and a cover for covering the gear storing chamber of the aforementioned body. This type of gasket is placed in a gasket groove which is disposed on at least one of the aforementioned body and cover. The gasket groove has a shape which surrounds the aforementioned gear storing chamber, a low pressure port communicating with an inlet when being used as a gear pump, and a high pressure port communicating with an outlet when being used as a gear pump, and is non-symmetric to a line segment connecting the centers of the gears (for example, refer to patent document 1).

In addition, a material of the gasket used in this type of gear pump or motor is selected according to a composition and physical properties of the operating liquid. More specifically, in a typical hydraulic circuit, nitrile rubber is adopted in a case when the operating liquid is used at room temperature or near that temperature. Flurorubber is adopted in a case when used under high temperature conditions.

Here, as a method for discerning between gaskets that are made of different materials, color may be added to the gasket, or a shape of the gasket in a state where an external force is not applied may be made to be different.

However, when the method of coloring the gasket is adopted, dye needs to be mixed to the main raw material of the gasket, such as nitrile rubber or flurorubber, when the gasket is manufactured. As such, problems such as insufficient strength of the gasket may occur. In addition, an increase in cost is generated stemming from the additional processes during manufacturing and the increase in the types of raw materials.

On the other hand, when the shape of the gasket in a state where an external force is not applied is made to be different, the gasket which is formed from a first material (such as nitrile rubber) is made to a circular shape, and the gasket which is formed from a second material (such as flurorubber) is made to an asymmetrical shape to the gasket groove.

However, when the shape of the gasket in a state where an external force is not applied is made to be asymmetrical to the shape of the gasket groove, the following problems occur. Namely, after inserting a gasket having such shape into the gasket groove, the elastic deformation of the gasket in the gasket groove is very minute. As such, the gasket may fall out during the manufacturing process of this type of gear pump or motor when the surface where the gasket groove is disposed is faced downwards. In addition, since the gasket is an asymmetrical shape, the direction of the gasket must be matched when the gasket is attached.

PRIOR ART DOCUMENTS

Patent Documents

Japan Unexamined Patent Publication 2002-257054

SUMMARY OF THE INVENTION

In view of the forgoing, the invention provides at least a solution to the problem where a gasket falls out during the manufacturing process of a gear pump or a motor.

In order to solve the aforementioned problems, a gear pump or a motor according to the invention has the following structure. Namely, a gear pump or a motor according to the invention includes gears which meshes each other and form a pair, axes pivotally supporting the gears, a body having a gear storing chamber internally for placing the gears, a cover for covering the gear storing chamber of the body, and a gasket is disposed between the body and the cover, wherein the gasket is insertable to a gasket groove disposed on at least one of the body and the cover, the gasket groove having a shape surrounding the gear storing chamber, and the gasket sticks closely to the gasket groove due to an elastic restoring force when inserted to the gasket groove.

In this way, the gasket inserted to the gasket groove sticks closely to the gasket groove due to the elastic restoring force, such that the problem where the gasket falls out during the manufacturing process of the gear pump or the motor may be suppressed.

In addition, if the gasket is a quadrangle shape that is symmetrical with respect to both of two diagonal lines of the quadrangle when an external force is not applied, the operation of inserting the gasket to the gasket groove may be performed by elastically deforming the gasket after matching any one of the vertexes of the quadrangle shape to a vertex of the gasket groove. Therefore, the time for the operation of matching a direction of the gasket may be reduced.

Furthermore, the gasket is selected from a gasket having the quadrangle shape when in a state where an external force is not applied, or a gasket having a circular shape when in a state where an external force is not applied, wherein a material of the gasket having the quadrangle shape and a material of the gasket having the circular shape are different. Since the shapes of the gaskets are different when in a state where an external force is not applied, the gaskets which are formed by different materials may be differentiated without coloring the gaskets. In other words, a reduction in strength or an increase in cost of the gasket due to coloring of the gasket may be prevented.

In addition, in the invention, "a quadrangle shape that is symmetrical with respect to both of two diagonal lines" is a principle referring to both the square shape and a diamond shape, and also includes those which include an R at the vertexes.

According to the invention, the problem where the gasket falls out during the manufacturing process of the gear pump or the motor may be solved.

Several exemplary embodiments accompanied with figures are described in detail below to further describe the disclosure in details.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
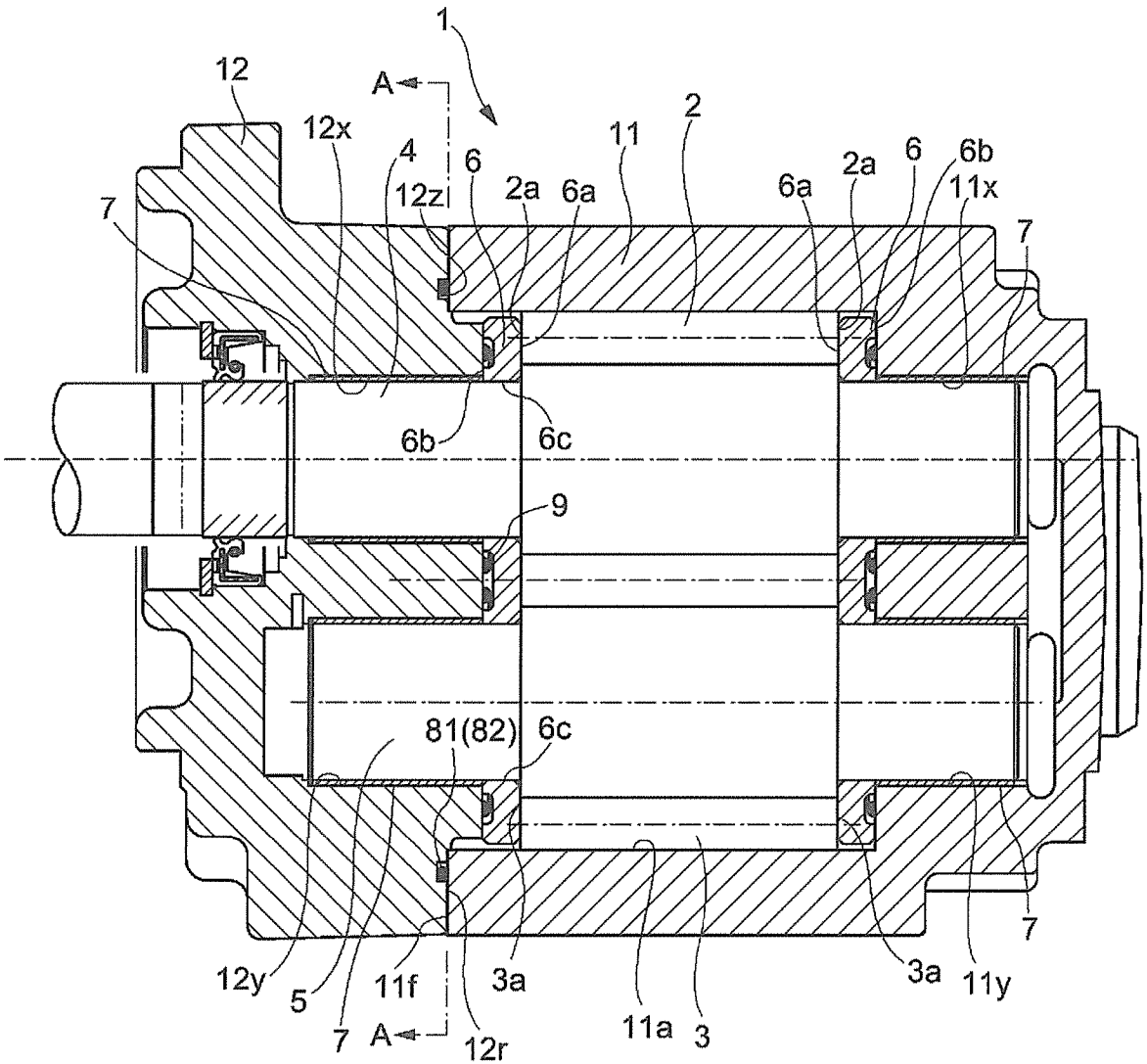
FIG. 1 is a figure illustrating a gear pump according to an embodiment of the invention.

Reference will now be made in detail to the present preferred embodiments of the invention, examples of which are illustrated in the accompanying drawings.

Wherever possible, the same reference numbers are used in the drawings and the description to refer to the same or like parts.

An embodiment of the invention is described below with reference to FIG. 1~FIG. 3.

As shown in FIG. 1, a gear pump according to the present embodiment mainly includes a casing 1 which is formed by connecting a body 11 having a gear storing chamber 11*a* internally and a cover 12 closing the gear storing chamber 11*a* of the body 11, an external gear pair, namely a driving gear 2 and a driven gear 3 which mesh together, placed and maintained in the gear storing chamber 11*a* of the casing 1, a driving axis 4 and a driven axis 5 for supporting the driving gear 2 and the driven gear 3, a slide plate 6 attached to a side surface of each of the driving gear 2 and the driven gear 3, and a bushing 7 disposed between each inner surface of the axis holes 11*x*, 11*y*, 12*x*, 12*y* and the driving axis 4 and driven axis 5, wherein axis holes 11*x*, 11*y*, 12*x*, 12*y* of the casing 1 are for placing each of the driving axis 4 and the driven axis 5 respectively.

The driving gear 2 and the driven gear 3 are conventional gears having a plurality of tooth bodies along an outer peripheral surface at predetermined spacing. In addition, in the present embodiment, the driving axis 4 is extended from a center of the driving gear 2 integrally in a rotation axis direction, and the driven axis 5 is extended from the driven gear 3 integrally in a rotation axis direction. However, the driving gear 2 and the driving axis 4 may be formed as separate bodies, and the driven gear 3 and the driven axis 5 may be formed as separate bodies.

The casing 1 connects the body 11 and the cover 12 with a fastening tool such as with a bolt not shown.

As shown in FIG. 1, the body 11 includes the gear storing chamber 11*a* for placing the driving gear 2 and the driven gear 3, a high pressure side port, not shown, communicating with the gear storing chamber 11*a*, a low pressure side port, not shown, also communicating with the gear storing chamber 11*a*, the axis holes 11*x*, 11*y* which are for pushing through the driving axis 4 and the driven axis 5 respectively. As aforementioned, the bushing 7 is disposed between the inner surface of the axis hole 11*x* and the driving axis 4, and between the inner surface of the axis hole 11*y* and the driven axis 5. Furthermore, a front surface 11*f* of the body 11 faces the cover 12.

As shown in FIG. 1, the cover 12 includes the axis holes 12*x*, 12*y* for pushing through the driving axis 2 and the driven axis 3. As aforementioned, the bushing 7 is disposed between the inner surface of the axis hole 12*x* and the driving axis 4, and between the inner surface of the axis hole 12*y* and the driven axis 5. In addition, a rear surface 12*r* of the cover 12 faces the body 11.

Figure 2:
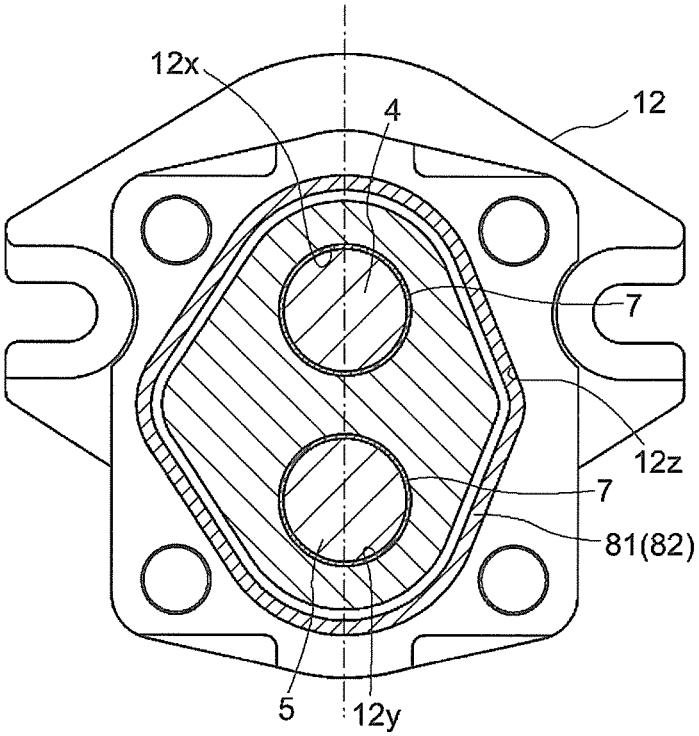
FIG. 2 is a cross-section diagram at A-A in FIG. 1.

As shown in FIG. 1~FIG. 3, the side plate 6 is disposed at 2 locations, namely attached to two side surfaces 2*a*, 3*a* of the driving gear 2 and the driven gear 3, and is used to seal each of the side surfaces 2*a*, 3*a* of the driving gear 2 and the driven gear 3 respectively. Here, on a side of a sliding surface 6*a* of the side plate 6, an operating liquid of high pressure is introduced from an outlet to the region of a high pressure side, and in a state where the driving gear 2, the driven gear 3 and the side plates 6, 6 are placed in the casing 1, then a seal part capable of guiding in high pressure liquid is formed between a non-sliding surface 6*b* of the side plate 6 and the casing 1. In addition, an axis insertion through hole 6*c* for allowing the driving axis 4 and the driven axis 5 to pass through is disposed on the side plate 6. Furthermore, a "3" shaped gasket 9 is disposed between the side plate and the cover 12.

The gasket with a number three shape 9 is formed by a material having elasticity. In addition, the gasket with a number three shape 9 is assembled to a gasket assembling protrusion disposed on the non-sliding surface 6*b* of the side plate 6 in an attached state, and then pressure bonded to the non-sliding surface 6*b* and the cover 12 to divide the space between the non-sliding surface 6*b* and the cover 12 into a low pressure region, namely a region of the inlet side, and a high pressure side region, namely a region of the outlet side.

As aforementioned and shown in FIG. 1 and FIG. 2, the bushing 7 is disposed between the driving axis 4 and the axis holes 11*x*, 12*x* of the body 11 and the front cover 12 respectively, and between the driving axis 5 and the axis holes 11*y*, 12*y* of the body 11 and the front cover 12 respectively.

In addition, in the present embodiment, gaskets of the invention, namely a first gasket 81 and a second gasket 82, are selectively disposed between the body 11 and the cover 12, more specifically between the front surface 11*f* of the body 11 and the rear surface 12*r* of the cover 12, as a sealing component. As aforementioned and as shown in FIG. 1 and FIG. 2, the first and the second gaskets 81, 82 are disposed in a gasket groove 12*z* disposed on the cover 12, and stick closely to the body 11 and the cover 12. The first and second gaskets 81, 82 are formed from different materials respectively, and may be selected according to a composition of the operating liquid and a temperature of use.

Figure 3A:
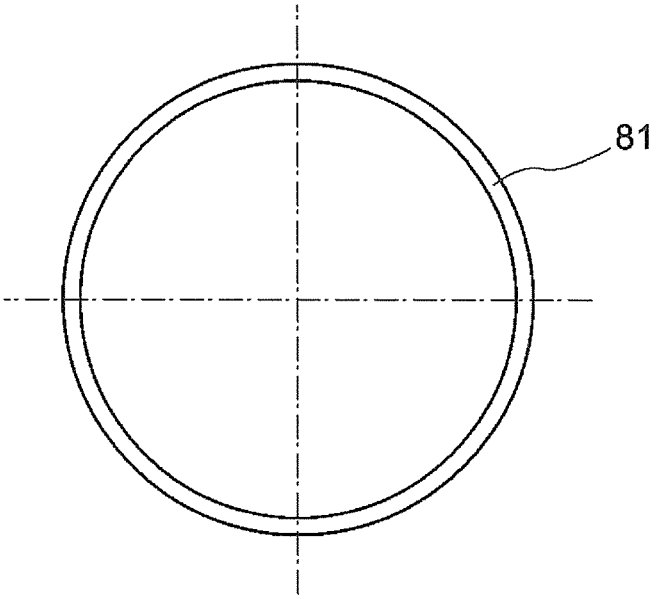
FIG. 3A and FIG. 3B are figures illustrating first and second gaskets according to the same embodiment.

The first gasket 81 is formed from a material with elasticity, more specifically nitrile rubber. As shown in FIG. 3A, the first gasket 81 has a circular shape when in a state where an external force is not applied. In addition, the first gasket 81 has a circular cross-section.

When the first gasket 81 is inserted in the gasket groove 12*z*, a part of the first gasket 81 is first inserted in the gasket groove 12*z*, then the first gasket 81 is elastically deformed to insert each part of the first gasket 81 in the gasket groove 12*z* in order. Then, the first gasket 81 sticks closely to the gasket groove 12*z* due to elastic restoring force.

Figure 3B:
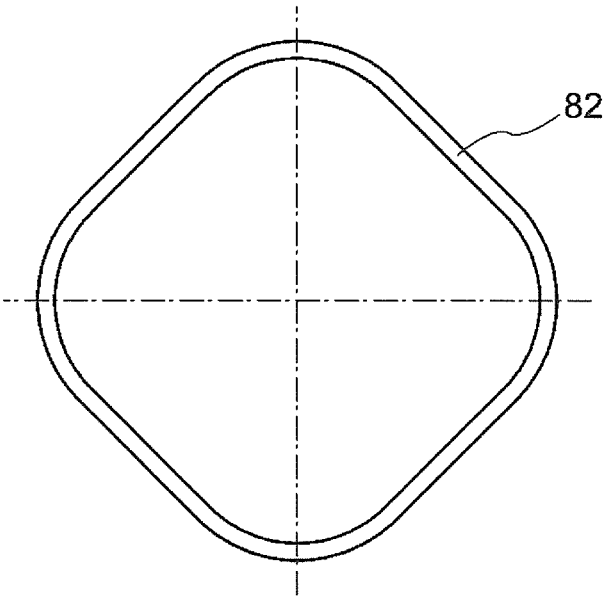

The second gasket 82 is formed by a material with elasticity, more specifically flurorubber. As shown in FIG. 3B, the second gasket 82 has a square shape having an R at the vertexes when in a state where an external force is not applied. In addition, the second gasket 82 also has a circular cross-section.

When the second gasket 82 is inserted in the gasket groove 12*z*, a part near a vertex of the second gasket 82 is first inserted in a part near a vertex of the gasket groove 12*z*, then the second gasket 82 is elastically deformed to insert each part of the second gasket 82 in the gasket groove 12*z* in order. Then, the second gasket 82 sticks closely to the gasket groove 12*z* due to elastic restoring force.

As aforementioned, according to a structure of the gear pump of the present embodiment, when any one of the first and second gaskets 81, 82 is to be attached, the gasket 81, 82 is elastically deformed to be inserted to the gasket groove 12*z*. Accordingly, the gasket 81, 82 inserted to the gasket groove 12*z* sticks closely to the gasket groove 12*z* due to elastic restoring force. Therefore, the problem where the gasket 81, 82 falls out during the manufacturing process of the gear pump or the motor may be suppressed.

In addition, since the second gasket 82 is a quadrangle shape that is symmetrical with respect to both of two diagonal lines when in a state where an external force is not applied, the operation of inserting the second gasket 82 to the gasket groove 12*z* may be performed by elastically deforming the second gasket 82 after matching any one of the vertexes of the quadrangle to a vertex of the gasket groove 12*z*. Therefore, the time for the operation of matching a direction of the second gasket 82 may be reduced.

In addition, the shapes of the first and second gaskets 81, 82 are different when in a state where an external force is not applied, and therefore the first and second gaskets 81, 82 which are formed by different materials may be differentiated without coloring the gaskets. In other words, a reduction in strength or an increase in cost of the gasket due to coloring of the gasket may be prevented.

In addition, the invention is not limited to the embodiments shown above.

For example, the gear pump according to the aforementioned embodiment adopts a configuration where the gear storing chamber of the body only has an opening at the front, and the front of the gear storing chamber is closed by the cover. However, in a gear pump configuration where a gear storing chamber of the body has openings at the front and rear, and the front and rear of the gear storing chamber are closed by a front cover and a rear cover respectively, the gasket of the invention may be attached to both, namely between the body and the front cover and between the body and the rear cover. On the other hand, in a gear pump configuration where a gear storing chamber of the body only has an opening at the rear, and the rear of the gear storing chamber is closed by a cover, the gasket of the invention may be attached to the connection point of the body and the cover.

In addition, in the aforementioned embodiments, the second gasket is a square shape when in a state where an external force is not applied. However, a second gasket having a diamond shape when in a state where an external force is not applied may be adopted as well. Furthermore, a radius of the R at the vertexes of the square or diamond gasket may be set arbitrarily.

In addition, various modifications can be made without departing from the scope or spirit of the invention.

What is claimed is:

1. A gear pump, comprising:

gears meshing with each other and forming a pair;

axes pivotally supporting the gears;

a body having a gear storing chamber internally for placing the gears;

a cover for covering the gear storing chamber of the body; and a gasket disposed between the body and the cover, wherein the gasket inserts into a gasket groove disposed on at least one of the body and the cover, the gasket groove having a shape surrounding the gear storing chamber, and the gasket sticks closely to the gasket groove due to an elastic restoring force when inserted to the gasket groove, wherein the gasket has a symmetrical shape when the gasket in a state where an external force is not applied and the gasket groove has an asymmetrical shape.

2. The gear pump as claimed in claim 1, wherein the gasket is a circular shape when in a state where an external force is not applied.

3. The gear pump as claimed in claim 1, wherein the gasket is a quadrangle shape that is symmetrical with respect to both of two diagonal lines of the quadrangle when in a state where an external force is not applied.

4. A motor, comprising:

gears meshing with each other and forming a pair;

axes pivotally supporting the gears;

a body having a gear storing chamber internally for placing the gears;

a cover for covering the gear storing chamber of the body; and a gasket disposed between the body and the cover, wherein the gasket inserts into a gasket groove disposed on at least one of the body and the cover, the gasket groove having a shape surrounding the gear storing chamber, and the gasket sticks closely to the gasket groove due to an elastic restoring force when inserted to the gasket groove, wherein the gasket has a symmetrical shape when the gasket in a state where an external force is not applied and the gasket groove has an asymmetrical shape.

5. The motor as claimed in claim 4, wherein the gasket is a circular shape when in a state where an external force is not applied.

6. The motor as claimed in claim 4, wherein the gasket is a quadrangle shape that is symmetrical with respect to both of two diagonal lines of the quadrangle when in a state where an external force is not applied.

7. A method of assembling a gear pump, the method comprising:

providing a pair of gears meshing with each other to form a pair of gears with axes that pivotally support the pair of gears;

placing the pair of gears inside a body having a gear storing chamber;

covering the pair of gears storing chamber of the body by using a cover;

disposing a gasket between the body and the cover; and inserting the gasket to a gasket groove disposed on at least one of the body and the cover, the gasket groove having a shape surrounding the gear storing chamber, and the gasket sticks closely to the gasket groove due to an elastic restoring force when inserted to the gasket groove, wherein the gasket has a symmetrical shape when the gasket is in a state where an external force is not applied and the gasket groove has an asymmetrical shape.

8. The method of claim 7, wherein the gasket is a quadrangle shape when an external force is not applied and is made of a first material which is symmetrical with respect to both of two diagonal lines of the quadrangle.

9. The method of claim 8, wherein the first material is nitrile rubber.

10. The method of claim 7, wherein the gasket is a circular shape when in a state where an external force is not applied and is made of a second material.

11. The method of claim 10, wherein the second material is flurorubber.

* * * * *